US008367285B2

(12) United States Patent
Vong et al.

(10) Patent No.: US 8,367,285 B2
(45) Date of Patent: Feb. 5, 2013

(54) LIGHT SHOCK RESISTANT OVERCOAT LAYER

(75) Inventors: Cuong Vong, Hamilton (CA); Yvan Gagnon, Mississauga (CA); Gregory McGuire, Oakville (CA)

(73) Assignee: Xerox Corporation, Norwalk, CT (US)

( * ) Notice: Subject to any disclaimer, the term of this patent is extended or adjusted under 35 U.S.C. 154(b) by 615 days.

(21) Appl. No.: 12/614,332

(22) Filed: Nov. 6, 2009

(65) Prior Publication Data

US 2011/0111334 A1 May 12, 2011

(51) Int. Cl.
*G03G 5/047* (2006.01)
*G03G 5/147* (2006.01)

(52) U.S. Cl. ..... 430/58.8; 430/66; 430/58.7; 430/59.6; 430/58.05

(58) Field of Classification Search ..... 430/66, 430/58.7, 59.6, 58.05, 58.8; 399/159
See application file for complete search history.

(56) References Cited

U.S. PATENT DOCUMENTS

| | | | | |
|---|---|---|---|---|
| 3,121,006 | A | 2/1964 | Middleton et al. | |
| 4,286,033 | A | 8/1981 | Neyhart et al. | |
| 4,291,110 | A | 9/1981 | Lee | |
| 4,338,387 | A | 7/1982 | Hewitt | |
| 4,387,980 | A | 6/1983 | Ueno et al. | |
| 4,464,450 | A | 8/1984 | Teuscher | |
| 4,587,189 | A | 5/1986 | Hor et al. | |
| 4,921,773 | A | 5/1990 | Melnyk et al. | |
| 5,069,993 | A | 12/1991 | Robinette et al. | |
| 5,215,839 | A | 6/1993 | Yu | |
| 5,370,953 | A * | 12/1994 | Nakatani | 430/58.05 |
| 5,660,961 | A | 8/1997 | Yu | |
| 5,681,679 | A * | 10/1997 | Schank et al. | 430/58.2 |
| 5,756,245 | A | 5/1998 | Esteghamatian et al. | |
| 5,958,638 | A | 9/1999 | Katayama et al. | |
| 6,713,220 | B2 * | 3/2004 | Graham et al. | 430/58.25 |
| 7,491,989 | B2 * | 2/2009 | Loutfy et al. | 257/290 |
| 7,932,006 | B2 * | 4/2011 | Dejong et al. | 430/66 |
| 2003/0194626 | A1 * | 10/2003 | Zhu et al. | 430/58.45 |
| 2004/0224244 | A1 * | 11/2004 | Fuller et al. | 430/58.8 |
| 2008/0089712 | A1 * | 4/2008 | Nukada et al. | 399/159 |

FOREIGN PATENT DOCUMENTS

| | | | |
|---|---|---|---|
| JP | 10020523 | A * | 1/1998 |
| JP | 2816238 | B2 * | 10/1998 |

OTHER PUBLICATIONS

English language machine translation of JP 10-020523 (Jan. 1998).*
English language machine translation of JP 2816238 B2 (Oct. 1998).*
Borsenberger, Paul M. et al. Organic Photoreceptors for Imaging Systems. New York: Marcel-Dekker, Inc. (1993) pp. 6-9.*

* cited by examiner

*Primary Examiner* — Christopher Rodee
(74) *Attorney, Agent, or Firm* — Pillsbury Winthrop Shaw Pittman LLP

(57) ABSTRACT

Embodiments pertain to a novel imaging member, namely, an imaging member or photoreceptor comprising an overcoat layer which comprises light-absorbing material that improves print quality. The light-absorbing material reduces the intrinsic light shock suffered by conventional overcoat layers without negatively impacting electrical properties of the overcoat layer.

10 Claims, 2 Drawing Sheets

LIGHT SHOCK RESISTANT OVERCOAT LAYER

BACKGROUND

The present embodiments pertain to a novel imaging member, namely, an imaging member or photoreceptor comprising an overcoat layer which comprises light-absorbing material that improves print quality. The light-absorbing material reduces the intrinsic light shock suffered by conventional overcoat layers without negatively impacting electrical properties of the overcoat layer.

In electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing or ionographic printing and reproduction where charge is deposited on a charge retentive surface in response to electronically generated or stored images.

To charge the surface of a photoreceptor, a contact type charging device has been used. The contact type charging device includes a conductive member which is supplied a voltage from a power source with a D.C. voltage superimposed with a A.C. voltage of no less than twice the level of the D.C. voltage. The charging device contacts the image bearing member (photoreceptor) surface, which is a member to be charged. The contact type charging device charges the image bearing member to a predetermined potential. Typically the contact type charger is in the form of a roll charger such as that disclosed in U.S. Pat. No. 4,387,980, the relative portions thereof incorporated herein by reference.

Multilayered photoreceptors or imaging members have at least two layers, and may include a substrate, a conductive layer, an optional undercoat layer (sometimes referred to as a "charge blocking layer" or "hole blocking layer"), an optional adhesive layer (sometimes referred to as an "interfacial layer"), a photogenerating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

The electrical properties of some photoreceptors can change upon exposure to certain wavelengths of light, and these undesirable changes can result in poor print quality. Past studies have shown that this problem is caused by a phenomenon called light shock, which is in turn due to the interaction of blue light with the photogenerating layer. Light shock can occur during exposure to ambient room light, for example, during installation of the photoreceptor or during servicing of a machine, such as a xerographic machine. In the case of organic photoreceptors having certain types of overcoat layers, it has been discovered that the light shock is intrinsic to the overcoat layer itself and strongly wavelength dependent (e.g., the majority of the light shock being caused by 400-500 nm light). Prior solutions focused on the interaction of light with the photogenerating layer but did not address intrinsic overcoat layer light shock protection. For example, U.S. Pat. No. 6,713,220, incorporated herein by reference, discloses a method for reducing the effects of light shock by preventing 400-500 nm light from interacting with the generator layer by doping a light-absorbing material into a charge transport layer comprising arylamine. However, intrinsic light shock observed in organic overcoat layers is not resolved by the method taught by U.S. Pat. No. 6,713,220. Thus, there is a need for a solution to the intrinsic light shock experienced by organic overcoat layers.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

SUMMARY

According to aspects illustrated herein, there is provided an imaging member, comprising a substrate, a charge generation layer disposed on the substrate, a charge transport layer disposed on the charge generation layer, and an overcoat layer disposed on the charge transport layer, wherein the overcoat layer comprises a light-absorbing material that absorbs light having a wavelength of about equal to or less than 700 nanometers and further wherein the light-absorbing material substantially prevents light interaction with the overcoat layer.

In another embodiment, there is provided an imaging member, comprising a substrate, a charge generation layer disposed on the substrate, a charge transport layer disposed on the charge generation layer, and an overcoat layer disposed on the charge transport layer, wherein the overcoat layer comprises a light-absorbing material that absorbs light having a wavelength of about equal to or less than 700 nanometers, and further wherein the imaging member exhibits a decrease in light shock as compared to an imaging member without the light-absorbing material in the overcoat layer.

Yet another embodiment, there is provided an image forming apparatus for forming images on a recording medium comprising a) an imaging member having a charge retentive-surface for receiving an electrostatic latent image thereon, wherein the imaging member comprises a substrate, a charge generation layer disposed on the substrate, a charge transport layer disposed on the charge generation layer, and an overcoat layer disposed on the charge transport layer, wherein the overcoat layer comprises a light-absorbing material that absorbs light having a wavelength of about equal to or less than 700 nanometers and further wherein the light-absorbing material substantially prevents light interaction with the overcoat layer, b) a development component for applying a developer material to the charge-retentive surface to develop the electrostatic latent image to form a developed image on the charge-retentive surface, c) a transfer component for transferring the developed image from the charge-retentive surface to a copy substrate, and d) a fusing component for fusing the developed image to the copy substrate.

BRIEF DESCRIPTION OF THE DRAWINGS

For a better understanding, reference may be made to the accompanying figures.

DETAILED DESCRIPTION

Figure 1:
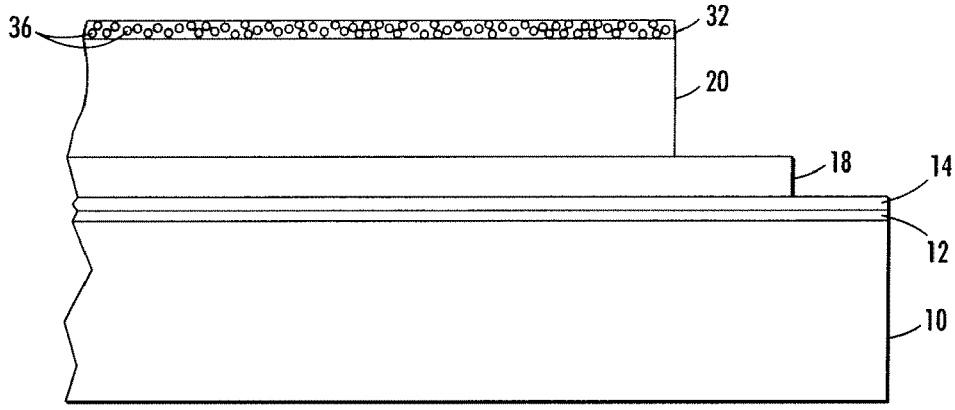
FIG. 1 is a cross-sectional view of an imaging member in a drum configuration according to the present embodiments.

In the following description, reference is made to the accompanying drawings, which form a part hereof and which illustrate several embodiments. It is understood that other embodiments may be used and structural and operational changes may be made without departure from the scope of the present disclosure.

The presently disclosed embodiments generally pertain to a novel imaging member or photoreceptor which comprises an overcoat layer that exhibits improved resistance to intrinsic light shock. As compared to the conventional organic overcoat layers, the improved overcoat layer exhibits good print quality and has little negative impact on overall electrical performance of the photoreceptor. For example, in one current overcoat layer formulation comprising a small transport molecule, a resin, a crosslinker compound, an acid catalyst, and one or more surface additives in a solvent, poor print quality is observed due to the intrinsic light shock of the overcoat layer.

The present embodiments provide an overcoat layer that incorporates into the overcoat formulation, a small concentration of light-absorbing material that strongly absorbs 400-575 nm light such as quinones, rubrene, yellow dyes, red dyes, and mixtures thereof. In specific embodiments, the light-absorbing material is selected from the group of diphenoquinone (DPQ). Diphenoquinone is a known electron transport molecule that strongly absorbs 400-460 nm light. Incorporation of such light-absorbing materials into the overcoat layer imparts resistance to intrinsic light shock without negatively impacting electricals.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

FIG. 1 is an exemplary embodiment of a multilayered electrophotographic imaging member having a drum configuration. As can be seen, the exemplary imaging member includes a rigid support substrate 10, an undercoat layer 14, a charge generation layer 18 and a charge transport layer 20. The rigid substrate may be comprised of a material selected from the group consisting of a metal, metal alloy, aluminum, zirconium, niobium, tantalum, vanadium, hafnium, titanium, nickel, stainless steel, chromium, tungsten, molybdenum, and mixtures thereof. The charge generation layer 18 and the charge transport layer 20 forms an imaging layer described here as two separate layers. In an alternative to what is shown in the figure, the charge generation layer may also be disposed on top of the charge transport layer. It will be appreciated that the functional components of these layers may alternatively be combined into a single layer.

Figure 2:
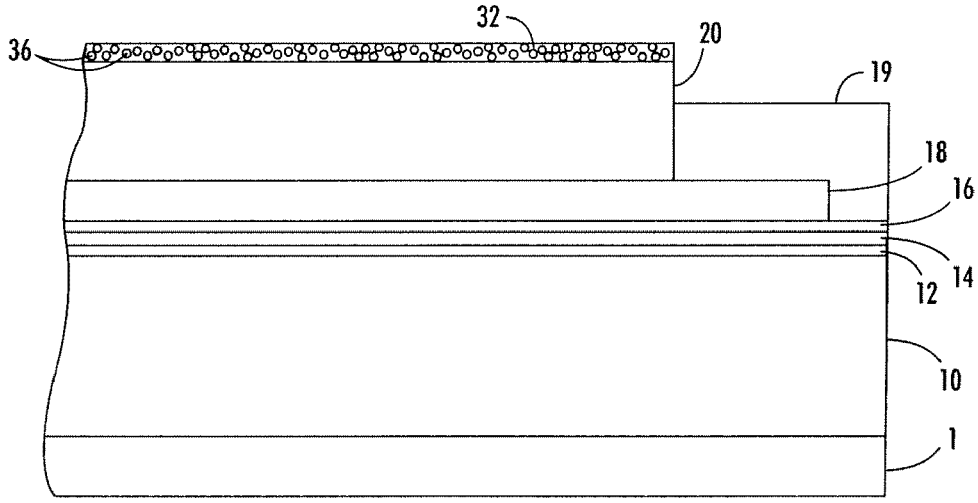
FIG. 2 is a cross-sectional view of an imaging member in a belt configuration according to the present embodiments.

FIG. 2 shows an imaging member having a belt configuration according to the embodiments. As shown, the belt configuration is provided with an anti-curl back coating 1, a supporting substrate 10, an electrically conductive ground plane 12, an undercoat layer 14, an adhesive layer (also referred to an interfacial layer) 16, a charge generation layer 18, and a charge transport layer 20. An optional overcoat layer 32 and ground strip 19 may also be included. An exemplary photoreceptor having a belt configuration is disclosed in U.S. Pat. No. 5,069,993, which is hereby incorporated by reference. Organic photoreceptors usually comprise a metalized substrate, undercoat layer, charge generation layer (CGL) and charge transport layer (CTL), sequentially. To form a latent image on the surface of photoreceptor, a charged photoreceptor has to be exposed by light, which usually is a laser with wavelength in visible light range. The ideal situation would be one in which the charge generation layer could absorb all the incident photons and no exposure light could penetrate through the CGL. In reality, however, there is always a small amount of light that passes through the CGL and UCL, and is then reflected back through the photoreceptor. This light interference results in a print defect.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed, such as for example, metal or metal alloy. Electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, niobium, stainless steel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, as shown in FIG. 2, the belt can be seamed or seamless. In embodiments, the photoreceptor herein is in a drum configuration as shown in FIG. 1.

The thickness of the substrate 10 depends on numerous factors, including flexibility, mechanical performance, and economic considerations. The thickness of the support substrate 10 of the present embodiments may be at least about 500 micrometers, or no more than about 3,000 micrometers, or be at least about 750 micrometers, or no more than about 2500 micrometers.

An exemplary substrate support 10 is not soluble in any of the solvents used in each coating layer solution, is optically transparent or semi-transparent, and is thermally stable up to a high temperature of about 150° C. A substrate support 10 used for imaging member fabrication may have a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm$^2$) and about $7\times10^{-5}$ psi ($4.9\times10^{-4}$ Kg/cm$^2$).

The Ground Plane

The electrically conductive ground plane 12 may be an electrically conductive metal layer which may be formed, for example, on the substrate 10 by any suitable coating technique, such as a vacuum depositing technique. Metals include aluminum, zirconium, niobium, tantalum, vanadium, hafnium, titanium, nickel, stainless steel, chromium, tungsten, molybdenum, and other conductive substances, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be at least about 20 Angstroms, or no more than about 750 Angstroms, or at least about 50 Angstroms, or no more than about 200 Angstroms for an optimum combination of electrical conductivity, flexibility and light transmission.

Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as transparent layer for light having a wavelength between about 4000 Angstroms and about 9000 Angstroms or a conductive carbon black dispersed in a polymeric binder as an opaque conductive layer.

The Hole Blocking Layer

After deposition of the electrically conductive ground plane layer, the undercoat or hole blocking layer 14 may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl)methyl diethoxysilane, and $[H_2N(CH_2)_3]CH_3Si(OCH_3)_2$(gamma-aminopropyl)methyl diethoxysilane, as disclosed in U.S. Pat. Nos. 4,338,387, 4,286,033 and 4,291,110.

General embodiments of the undercoat layer may comprise a metal oxide and a resin binder. The metal oxides that can be used with the embodiments herein include, but are not limited to, titanium oxide, zinc oxide, tin oxide, aluminum oxide, silicon oxide, zirconium oxide, indium oxide, molybdenum oxide, and mixtures thereof. Undercoat layer binder materials may include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like.

The hole blocking layer should be continuous and have a thickness of less than about 0.5 micrometer because greater thicknesses may lead to undesirably high residual potential. A hole blocking layer of between about 0.005 micrometer and about 0.3 micrometer is used because charge neutralization after the exposure step is facilitated and optimum electrical performance is achieved. A thickness of between about 0.03 micrometer and about 0.06 micrometer is used for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Charge Generation Layer

The charge generation layer 18 may thereafter be applied to the undercoat layer 14. Any suitable charge generation binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, enzimidazole perylene, and the like, and mixtures thereof, dispersed in a film forming polymeric binder. Selenium, selenium alloy, benzimidazole perylene, and the like and mixtures thereof may be formed as a continuous, homogeneous charge generation layer. Benzimidazole perylene compositions are well known and described, for example, in U.S. Pat. No. 4,587,189, the entire disclosure thereof being incorporated herein by reference. Multi-charge generation layer compositions may be used where a photoconductive layer enhances or reduces the properties of the charge generation layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generation layer 18, including those described, for example, in U.S. Pat. No. 3,121,006, the entire disclosure thereof being incorporated herein by reference. Organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation (Tokyo, Japan).

The charge generating material can be present in the resinous binder composition in various amounts. Generally, at least about 5 percent by volume, or no more than about 90 percent by volume of the charge generating material is dispersed in at least about 95 percent by volume, or no more than about 10 percent by volume of the resinous binder, and more specifically at least about 20 percent, or no more than about 60 percent by volume of the charge generating material is dispersed in at least about 80 percent by volume, or no more than about 40 percent by volume of the resinous binder composition.

In specific embodiments, the charge generation layer 18 may have a thickness of at least about 0.1 μm, or no more than about 2 μm, or of at least about 0.2 μm, or no more than about 1 μm. These embodiments may be comprised of chlorogallium phthalocyanine or hydroxygallium phthalocyanine or mixtures thereof. The charge generation layer 18 containing the charge generating material and the resinous binder material generally ranges in thickness of at least about 0.1 μm, or no more than about 5 μm, for example, from about 0.2 μm to about 3 μm when dry. The charge generation layer thickness is generally related to binder content. Higher binder content compositions generally employ thicker layers for charge generation.

The Charge Transport Layer

In a drum photoreceptor, the charge transport layer comprises a single layer of the same composition. As such, the charge transport layer will be discussed specifically in terms of a single layer 20, but the details will be also applicable to an embodiment having dual charge transport layers. The charge transport layer 20 is thereafter applied over the charge generation layer 18 and may include any suitable transparent organic polymer or non-polymeric material capable of supporting the injection of photogenerated holes or electrons from the charge generation layer 18 and capable of allowing the transport of these holes/electrons through the charge transport layer to selectively discharge the surface charge on the imaging member surface. In one embodiment, the charge transport layer 20 not only serves to transport holes, but also protects the charge generation layer 18 from abrasion or chemical attack and may therefore extend the service life of the imaging member. The charge transport layer 20 can be a substantially non-photoconductive material, but one which supports the injection of photogenerated holes from the charge generation layer 18.

The layer 20 is normally transparent in a wavelength region in which the electrophotographic imaging member is to be used when exposure is affected there to ensure that most of the incident radiation is utilized by the underlying charge generation layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generation layer 18 is sandwiched between the substrate and the charge transport layer 20. The charge transport layer 20 in conjunction with the charge generation layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive dissolved or molecularly dispersed in an electrically inactive polymeric material, such as a polycarbonate binder, to form a solid solution and thereby making this material electrically active. "Dissolved" refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The high mobility charge transport component may comprise small molecules of an organic compound which cooperate to transport charge between molecules and ultimately to the surface of the charge transport layer. For example, but not limited to, N,N'-diphenyl-N,N-bis(3-methyl phenyl)-1,1'-biphenyl-4,4'-diamine (TPD), other arylamines like triphenyl amine, N,N,N',N'-tetra-p-tolyl-1,1'-biphenyl-4,4'-diamine (TM-TPD), and the like.

A number of charge transport compounds can be included in the charge transport layer, which layer generally is of a thickness of from about 5 to about 75 micrometers, and more specifically, of a thickness of from about 15 to about 40 micrometers. Examples of charge transport components are aryl amines of the following formulas/structures:

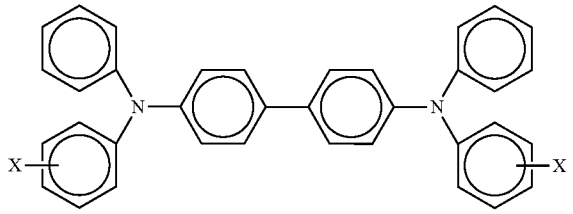

and

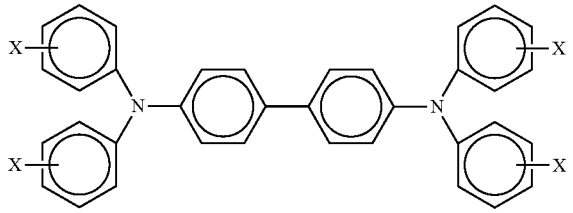

wherein X is a suitable hydrocarbon like alkyl, alkoxy, aryl, and derivatives thereof; a halogen, or mixtures thereof, and especially those substituents selected from the group consisting of Cl and $CH_3$; and molecules of the following formulas

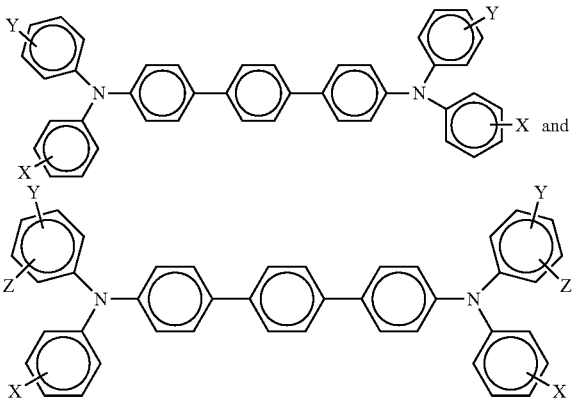

wherein X, Y and Z are independently alkyl, alkoxy, aryl, a halogen, or mixtures thereof, and wherein at least one of Y and Z are present.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines that can be selected for the charge transport layer include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules may be selected in embodiments, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), and epoxies, and random or alternating copolymers thereof. In embodiments, the charge transport layer, such as a hole transport layer, may have a thickness of at least about 10 μm, or no more than about 40 μm.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SANKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layer is from about 0 to about 20, from about 1 to about 10, or from about 3 to about 8 weight percent.

The charge transport layer should be an insulator to the extent that the electrostatic charge placed on the hole transport layer is not conducted in the absence of illumination at a rate sufficient to prevent formation and retention of an electrostatic latent image thereon. The charge transport layer is substantially nonabsorbing to visible light or radiation in the region of intended use, but is electrically "active" in that it allows the injection of photogenerated holes from the photoconductive layer, that is the charge generation layer, and allows these holes to be transported through itself to selectively discharge a surface charge on the surface of the active layer.

In addition, in the present embodiments using a belt configuration, the charge transport layer may consist of a single pass charge transport layer or a dual pass charge transport layer (or dual layer charge transport layer) with the same or different transport molecule ratios. In these embodiments, the dual layer charge transport layer has a total thickness of from about 10 μm to about 40 μm. In other embodiments, each layer of the dual layer charge transport layer may have an individual thickness of from 2 μm to about 20 μm. Moreover, the charge transport layer may be configured such that it is used as a top layer of the photoreceptor to inhibit crystallization at the interface of the charge transport layer and the overcoat layer. In another embodiment, the charge transport layer may be configured such that it is used as a first pass charge transport layer to inhibit microcrystallization occurring at the interface between the first pass and second pass layers.

Any suitable and conventional technique may be utilized to form and thereafter apply the charge transport layer mixture to the supporting substrate layer. The charge transport layer may be formed in a single coating step or in multiple coating steps. Dip coating, ring coating, spray, gravure or any other drum coating methods may be used.

Drying of the deposited coating may be effected by any suitable conventional technique such as oven drying, infra red radiation drying, air drying and the like. The thickness of the charge transport layer after drying is from about 10 μm to about 40 μm or from about 12 μm to about 36 μm for optimum photoelectrical and mechanical results. In another embodiment the thickness is from about 14 μm to about 36 μm.

The Overcoat Layer

To provide an overcoat layer 32 that exhibits improved resistance to light shock and also exhibits good electrical performance as compared to conventional overcoat layers employed in organic photoreceptors, the present embodiments employ an overcoat layer 32 doped with a light-absorbing material 36. In the present embodiments, the overcoat layer formulation comprises a specific light-absorbing material 36 selected from the group consisting of quinones, rubrene, yellow dyes, red dyes, and mixtures thereof. These embodiments exhibit increased resistance to intrinsic light shock, especially the light shock caused by 400-500 nm light. Generally, the light-absorbing material substantially prevents light of a wavelength of about equal to or about less than 700 nanometers from interacting with the overcoat layer. The substantial prevention of interaction between light and the overcoat layer is based on the fact that the dopant or light-absorbing material absorbs light strongly in the 400 to 500 nm range and thus absorbs the majority of light that would otherwise interact with the overcoat layer and cause the light shock effect.

In embodiments, the overcoat layer is formed from a formulation or solution comprising a small transport molecule, a resin, a crosslinker compound, an acid catalyst, and one or more surface additives in a solvent. To facilitate the crosslinking process, the combination of the small transport molecule and the crosslinker compound takes place in the presence of a strong acid solution.

In embodiments the small transport molecule can be selected from the group consisting of N,N'-diphenyl-N—N'-bis(hydroxyphenyl)-[1,1'-terphenyl]-4,4'-diamine (DHTER), N,N'-diphenyl-N,N'-bis(3-hydroxyphenyl)-[1,1'-biphenyl]-4,4'-diamine (DHTBD), and the like, and mixtures thereof. In embodiments, the resin can be selected from the group consisting of polyesterpolyols, polyacrylatepolyols, and the like, and mixtures thereof. One specific resin used is JONCRYL, an acrylic polyol, available from BASF Corp. (Florham Park, N.J.). The crosslinker compound may be, in embodiments, selected from the group consisting of methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin and the like, and mixtures thereof. In one example, the melamine formaldehyde crosslinker compound is CYMEL 303, available from Cytec Corporation (West Paterson, N.J.). An acid catalyst may be selected from the group consisting of toluenesulfonic acid, amine-protected toluenesulfonic acid, and the like, and mixtures thereof. In embodiments, the acid catalyst used is NACURE XP-357 available from King Industries (Norwalk, Conn.). The surface additives may be selected from the group consisting of alkylsilanes, perfluorinated alkylalcohols, and the like, and mixtures thereof. In specific embodiments, the surface additive is SILCLEAN 3700, a solution of a silicone modified polyacrylate (OH-functional) which can be crosslinked into a polymer network due to its —OH functionality. SILCLEAN 3700 is available from BYK-Chemie GmbH (Wesel, Germany). The solvent may be selected from the group consisting of alcohols, ethers, esters, ketones, and the like and mixtures thereof. In one embodiment, the solvent used is a glycol ether and is available at about 20 percent solids (DOWANOL PM), available from The Dow Chemical Co. (Midland, Mich.).

Incorporation of the light-absorbing material into the above overcoat solution provides an overcoat layer that exhibits substantial resistance to intrinsic light shock. The light-absorbing material absorbs light having a wavelength equal to or less than 700 nm. In specific embodiments, the light-absorbing material absorbs light having a wavelength of from about 400 nm to about 575 nm. In embodiments, the light-absorbing material is present in an amount of from about 1 percent to about 10 percent, or from about 2 percent to about 3 percent of the overcoat solution.

In further embodiments, the small transport molecule is present in an amount of from about 40 percent to about 70 percent, or from about 35 percent to about 40 percent of the overcoat solution. In other embodiments, the resin is present in an amount of from about 30 percent to about 60 percent, or from about 24 percent to about 28 percent of the overcoat solution. In embodiments, the crosslinker compound is present in an amount of from about 5 percent to about 35 percent, or from about 4 percent to about 6 percent of the overcoat solution. In the present embodiments, the acid catalyst is present in an amount of from about 0.5 percent to about 3 percent, or from about 1 percent to about 2 percent of the overcoat solution. In the present embodiments, one or more surface additives are present in an amount of from about 1 percent to about 6 percent, or from about 1 percent to about 2 percent of the overcoat solution. In yet further embodiments, the solvent is present in an amount of from about 18 percent to about 35 percent, or from about 20 percent to about 24 percent of the overcoat solution.

In embodiments, the light-absorbing material is present in an amount of from about 0.1 percent to about 10 percent, or from about 2 percent to about 5 percent of the dried overcoat layer. In particular embodiments, the small transport molecule is present in an amount of from about 34 percent to about 36 percent, or from about 34.5 percent to about 35.5 percent of the dried overcoat layer. In embodiments, the crosslinker compound is present in an amount of from about 35 percent to about 39 percent, or from about 36.5 percent to about 37.5 percent of the dried overcoat layer. In other embodiments, the resin is present in an amount of from about 24 percent to about 29 percent, or from about 26 percent to about 27 percent of the dried overcoat layer. In addition, in embodiments, the one or more surface additives may be present in an amount of from about 1 percent to about 3 percent, or from about 1 percent to about 2 percent of the dried overcoat layer.

The prepared overcoat solution is subsequently coated and dried onto the photoreceptor. The average thickness of the dried overcoat layer after being dried at 155° C. for 40 minutes is from about 3 microns to about 7 microns, or from about 3 microns to about 4 microns.

Unlike the conventional overcoat layers, the overcoat layer formed from the present embodiments prevents light shock intrinsic to the overcoat layer itself and thus improves print quality without negatively impacting overall electrical performance.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Comparative Example I

A photoconductor was prepared as follows. A three component hole blocking or undercoat layer was prepared as follows. Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was coated via a dip coater on a 30 millimeter aluminum tube, and the layer resulting was pre-heated at 59° C. for 13 minutes, humidified at 58° C. (dew point of 54° C.) for 17 minutes, and dried at 135° C. for 8 minutes. The thickness of the undercoat layer obtained was approximately 1.3 microns.

A photogenerating layer of a thickness of about 0.2 micron comprising hydroxygallium phthalocyanine Type V was deposited on the above hole blocking layer or undercoat layer with a thickness of about 1.3 microns. The photogenerating layer coating dispersion was prepared as follows. 3 Grams of hydroxygallium Type V pigment were mixed with 2 grams of a polymeric binder of a carboxyl-modified vinyl copolymer, VMCH, available from Dow Chemical Company, and 45 grams of n-butyl acetate. The resulting mixture was milled in an Attritor mill with about 200 grams of 1 millimeter Hi-Bea borosilicate glass beads for about 3 hours. The dispersion obtained was filtered through a 20 micron Nylon cloth filter, and the solid content of the dispersion was diluted to about 6 weight percent.

Subsequently, an 18 micron thick charge transport layer was coated on top of the photogenerating layer from a solution prepared from N,N'-diphenyl-N,N-bis(3-methylphenyl)-1,1'-biphenyl-4,4'-diamine (5 grams), a film forming polymer binder PCZ 400 [poly(4,4'-dihydroxy-diphenyl-1-1-cyclohexane, $M_w$, of 40,000)] available from Mitsubishi Gas Chemical Company, Ltd. (7.5 grams) in a solvent mixture of 30 grams of tetrahydrofuran (THF), and 10 grams of monochlorobenzene (MCB) via simple mixing. The charge transport layer was dried at about 135° C. for about 40 minutes.

Comparative Example II

An overcoated photoconductor was prepared by repeating the process of Comparative Example I except that an overcoating solution was formed by adding 4.53 grams of CYMEL® 303 (a methylated, butylated melamine-formaldehyde obtained from Cytec Industries Inc.), 4.22 grams of N,N'-diphenyl-N,N'-bis(3-hydroxyphenyl)-[1,1'-biphenyl]-4,4'-diamine (DHTBD), 3.24 grams of JONCRYL resin, 0.12 grams of BYK-SILCLEAN® 3700 (a hydroxylated silicone modified polyacrylate obtained from BYK-Chemie USA), and 0.12 gram of NACURE® XP357 (a blocked acid catalyst obtained from King Industries) in 48.8 grams of DOWANOL® PM (1-methoxy-2-propanol obtained from the Dow Chemical Company). The overcoating layer solution was applied on top of the charge transport layer, and upon drying at 155° C. for 40 minutes, a 4 micron thick overcoating layer was formed.

Example I

An overcoated photoconductor was prepared by repeating the process of Comparative Example II except that 0.4 grams of Diphenoquinone (DPQ) was added to the overcoat formulation.

Test Results

The above prepared three photoconductor devices (Comparative Example I and II and Example I) were tested in a scanner to obtain photoinduced discharge curves, wherein with each scanner cycle the xerographic exposure light intensity was incrementally decreased to produce a series of surface potentials at various exposure intensities.

The scanner was equipped with a scorotron set to a constant voltage charging. The devices were tested at surface potentials of −700V (volts) with the exposure light intensity incrementally decreased with a data acquisition system where the current to the light emitting diode was controlled to obtain different exposure levels. The exposure light source was a 780 nanometer light emitting diode. The xerographic simulation was completed in an environmentally controlled light tight chamber at ambient conditions (45 percent relative humidity and 20° C.).

Photoinduced discharge characteristics (PIDC) were completed on all three photoconductors. Photoinduced discharge curves demonstrated no difference between the drum with the control overcoat layer and the inventive drum coated with the overcoat layer comprising Diphenoquinone (DPQ). Table 1 provides a summary of the electrical properties.

TABLE 1

| Sample Details | Overcoat Thickness (nm) | $V_o$ (V) | $V_{dd}$ (V) | S (Verg/cm$^2$) | V(3) (V) | V(10) (V) | $V_r$ (V) |
|---|---|---|---|---|---|---|---|
| Control Device (Comparative Ex. 1) | 0.0 | 686 | 18 | 199 | 219 | 62 | 39 |
| Comparative Ex. 2 | 3.1 | 693 | 19 | 178 | 337 | 177 | 135 |
| Example 1 | 2.9 | 696 | 17 | 192 | 327 | 172 | 131 |

With reference to the abbreviations employed in Table 1:

$V_0$ is the initial surface potential;

$V_{dd}$ is the lost potential before light exposure (dark decay);

S is the initial slope of the PIDC curve and is a measurement of sensitivity;

$E_{1/2}$ is the light sensitivity of the photoreceptor when the surface potential has decayed to half of that at the start of said exposure;

V(3) is the surface potential at 3 ergs/cm$^2$ light exposure;

V(10) is the surface potential at 10 ergs/cm$^2$ light exposure; and $V_r$ is the residual surface potential after light erase.

The summary of electrical properties clearly shows that doping the overcoat layer with 3% DPQ has no negative impact on electrical properties.

Figure 3:
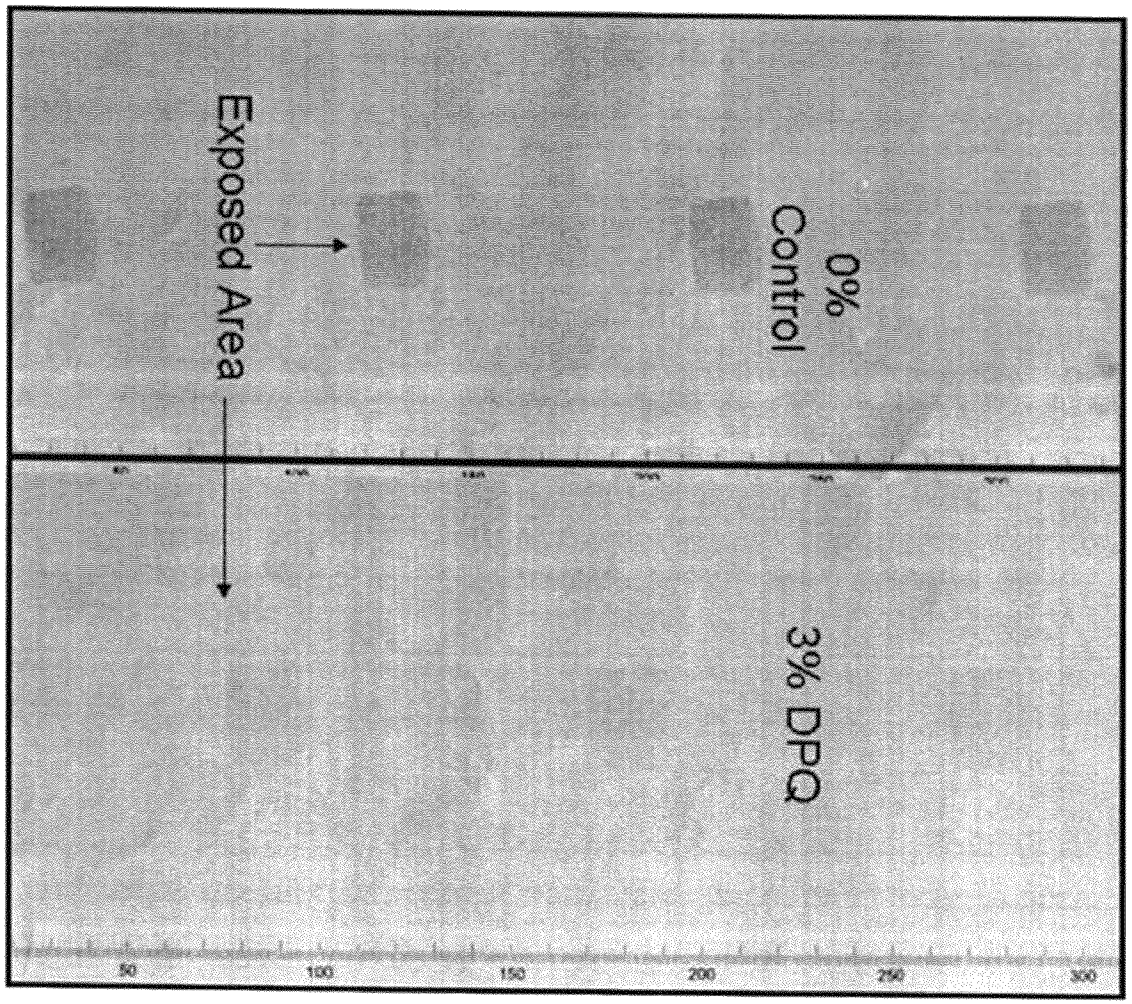
FIG. 3 is a comparison of prints produced by an image-forming apparatus having a conventional overcoat layer and an image-forming apparatus having the inventive overcoat layer according to the present embodiments.

Light Shock evaluation was completed by exposing a small portion of the drum (1 inch square) to a defined amount of light with a wavelength between 400 and 500 nm. The drums were then machine-tested on a conventional image-forming apparatus and the results are shown in FIG. 3. Light shock manifests itself as an unwanted change in electrical characteristics in the area exposed to 400-500 nm light, and this in turn exhibits an unwanted change in print halftone in said area. As can been seen from FIG. 3, doping the standard overcoat layer with 3% DPQ resulted in a significant improvement in the photoreceptor resistance to light shock as compared to the photoreceptor without DPQ. The drum with 3% DPQ exhibits very little change in print halftone while the drum without DPQ exhibits significant darkening of halftone in the exposed area. The light shock print test demonstrates a dramatic benefit of the addition of a small amount of light-absorbing material, such as DPQ, into the overcoat layer.

In summary, the present embodiments provide an overcoat layer that demonstrates marked improvement in resistance to light shock as compared to a current, conventional overcoat layer used. Furthermore, the present embodiments provide better print quality without any negative impact on electrical performance.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member, comprising:

a substrate;

a charge generation layer disposed on the substrate;

a charge transport layer disposed on the charge generation layer; and an overcoat layer disposed on the charge transport layer, wherein the overcoat layer comprises a light-absorbing material that comprises diphenoquinone and absorbs light having a wavelength of from 400 to 460 nanometers, and further wherein the imaging member exhibits a decrease in light shock as compared to an imaging member without the light-absorbing material in the overcoat layer and the overcoat layer is formed from an overcoat solution comprising the light-absorbing material, N,N'-diphenyl-N,N'-bis(3-hydroxyphenyl)-[1,1'-biphenyl]-4,4'-diamine (DHTBD), a hydroxylated silicone modified polyacrylate, methylated butylated melamine-formaldehyde, an acid catalyst, and one or more surface additives in a solvent.

2. The imaging member of claim 1, wherein the light-absorbing material is present in an amount of from about 2 percent to about 5 percent of the overcoat solution.

3. The imaging member of claim 1, wherein the light-absorbing material is present in an amount of from about 0.1 percent to about 10 percent of the overcoat layer.

4. The imaging member of claim 1, wherein the solvent is selected from the group consisting of alcohols, ethers, esters, ketones, and mixtures thereof.

5. The imaging member of claim 1, wherein the light-absorbing material is present in an amount of from about 1 percent to about 10 percent of the overcoat solution.

6. The imaging member of claim 5, wherein the light-absorbing material is present in an amount of from about 2 percent to about 3 percent of the overcoat solution.

7. The imaging member of claim 1, wherein the small transport molecule is present in an amount of from about 40 percent to about 70 percent of the overcoat solution.

8. The imaging member of claim 1, wherein the resin is present in an amount of from about 30 percent to about 60 percent of the overcoat solution.

9. The imaging member of claim 1, wherein the crosslinker compound is present in an amount of from about 5 percent to about 35 percent of the overcoat solution.

10. An image forming apparatus for forming images on a recording medium comprising:

a) an imaging member having a charge retentive-surface for receiving an electrostatic latent image thereon, wherein the imaging member comprises a substrate, a charge generation layer disposed on the substrate, a charge transport layer disposed on the charge generation layer, and an overcoat layer disposed on the charge transport layer, wherein the overcoat layer comprises a light-absorbing material that comprises diphenoquinone and absorbs light having a wavelength of from 400 to 460 nanometers, and further wherein the imaging member exhibits a decrease in light shock as compared to an imaging member without the light-absorbing material in the overcoat layer and the overcoat layer is formed from an overcoat solution comprising the light-absorbing material, N,N'-diphenyl-N,N'-bis(3-hydroxyphenyl)-[1,1'-biphenyl]-4,4'-diamine (DHTBD), a hydroxylated silicone modified polyacrylate, methylated butylated melamine-formaldehyde, an acid catalyst, and one or more surface additives in a solvent;

b) a development component for applying a developer material to the charge-retentive surface to develop the electrostatic latent image to form a developed image on the charge-retentive surface;

c) a transfer component for transferring the developed image from the charge-retentive surface to a copy substrate; and d) a fusing component for fusing the developed image to the copy substrate.

* * * * *